US011272775B1

(12) United States Patent
Kizzee

(10) Patent No.: US 11,272,775 B1
(45) Date of Patent: Mar. 15, 2022

(54) LOTION DISPENSING AND APPLYING DEVICE

(71) Applicant: Christina Kizzee, Missouri City, TX (US)

(72) Inventor: Christina Kizzee, Missouri City, TX (US)

( * ) Notice: Subject to any disclaimer, the term of this patent is extended or adjusted under 35 U.S.C. 154(b) by 0 days.

(21) Appl. No.: 17/009,014

(22) Filed: Sep. 1, 2020

(51) Int. Cl.
*B43K 5/02* (2006.01)
*A46B 5/02* (2006.01)
*A45D 34/04* (2006.01)

(52) U.S. Cl.
CPC ..... *A45D 34/04* (2013.01); *A45D 2200/053* (2013.01); *A45D 2200/054* (2013.01); *A45D 2200/056* (2013.01); *A45D 2200/1018* (2013.01); *A45D 2200/1081* (2013.01)

(58) Field of Classification Search
CPC ..... A45D 34/04; A45D 2200/1081; A45D 2200/053; A45D 2200/056
USPC ..... 401/6, 188 R
See application file for complete search history.

(56) References Cited

U.S. PATENT DOCUMENTS 5,240,339 A 8/1993 DeForest
5,961,235 A * 10/1999 Kennedy ..... A45D 34/04 401/140
6,170,108 B1 1/2001 Knight
6,190,073 B1 2/2001 Kabigting
6,261,014 B1 7/2001 Altobellis
6,325,564 B1 * 12/2001 Knowles ..... A45D 34/042 401/171
6,964,536 B1 * 11/2005 Alhateeb ..... A45D 34/041 401/208
7,309,180 B2 12/2007 Russell
D625,467 S 10/2010 Dickman
8,015,653 B2 * 9/2011 Bargiel ..... A45D 34/04 15/144.2
8,360,668 B1 * 1/2013 Hinnant ..... A46B 11/0096 401/188 R
8,926,210 B2 * 1/2015 Orubor ..... A47L 1/05 401/188 R
8,967,898 B1 3/2015 Dayeh
9,055,845 B1 * 6/2015 Hooper ..... A47K 7/028
2015/0008210 A1 1/2015 Davis
2016/0243566 A1 * 8/2016 Martiskainen ..... B05B 7/2416

* cited by examiner

*Primary Examiner* — Jennifer C Chiang

(57) ABSTRACT

A lotion dispensing and applying device for hard to reach areas includes a tube that define a reservoir, which is configured to position a lotion. A plate and a pumping module are coupled to a first end and second end of the tube, respectively. A pad is coupled to and substantially covers a first face of the plate. A channel extends from a front face of the pad through the pad and the plate to the tube. An outlet pipe is coupled to the pumping module and extends through the tube to the plate so that the pumping module is fluidically coupled to the channel. The pumping module is configured to selectively transfer the lotion from the reservoir through the outlet pipe and the channel to the front face of the pad so that the lotion is applicable to a skin surface.

18 Claims, 4 Drawing Sheets

LOTION DISPENSING AND APPLYING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to lotion applying devices and more particularly pertain to a new lotion applying device for hard to reach areas.

BRIEF SUMMARY OF THE INVENTION

An embodiment of the disclosure meets the needs presented above by generally comprising a tube that define a reservoir, which is configured to position a lotion. A plate and a pumping module are coupled to a first end and second end of the tube, respectively. A pad is coupled to and substantially covers a first face of the plate. A channel extends from a front face of the pad through the pad and the plate to the tube. An outlet pipe is coupled to the pumping module and extends through the tube to the plate so that the pumping module is fluidically coupled to the channel. The pumping module is configured to selectively transfer the lotion from the reservoir through the outlet pipe and the channel to the front face of the pad so that the lotion is applicable to a skin surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
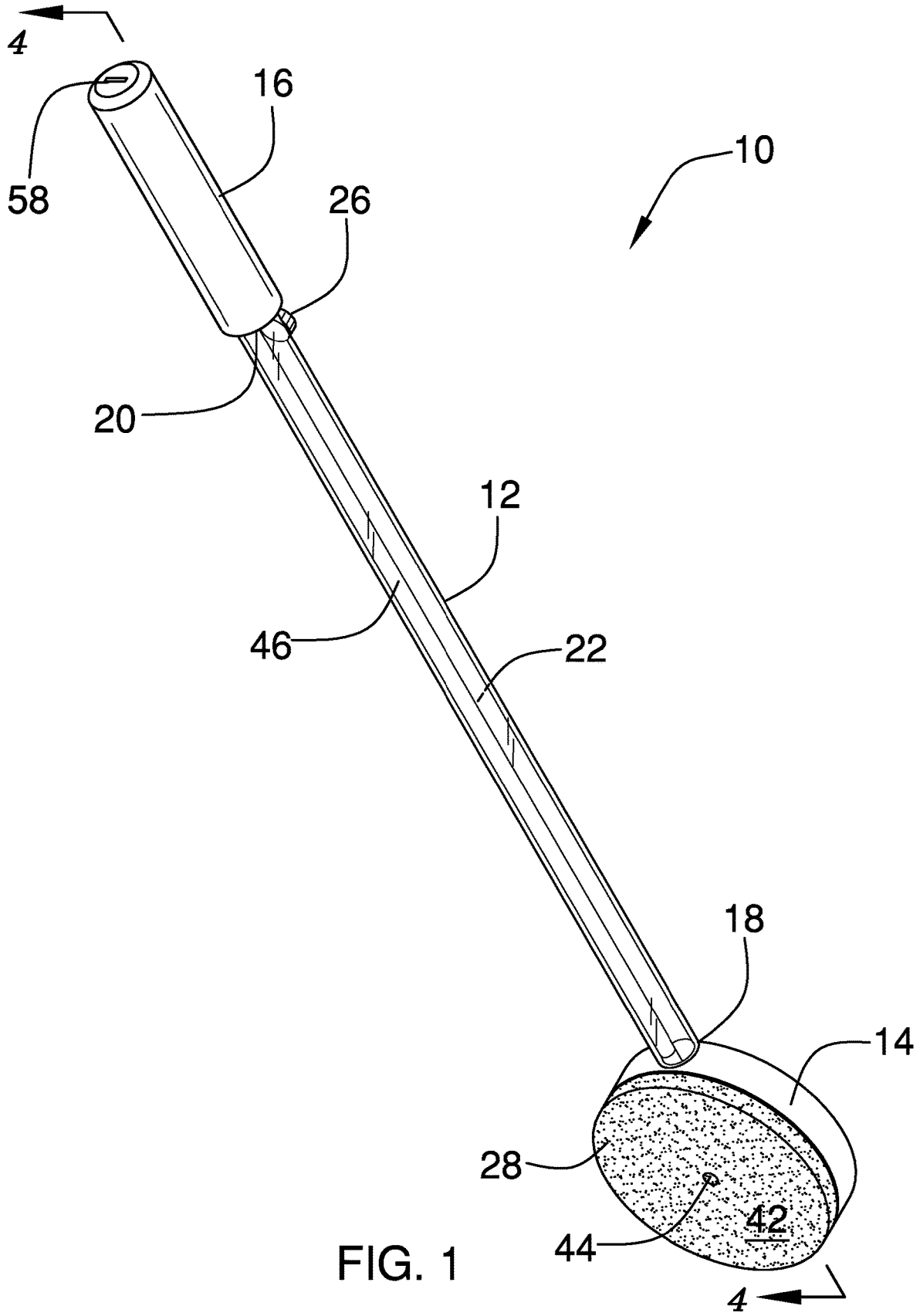
FIG. 1 is a front isometric perspective view of a lotion dispensing and applying device according to an embodiment of the disclosure.

With reference now to the drawings, and in particular to FIGS. 1 through 5 thereof, a new lotion applying device embodying the principles and concepts of an embodiment of the disclosure and generally designated by the reference numeral 10 will be described.

As best illustrated in FIGS. 1 through 5, the lotion dispensing and applying device 10 generally comprises a tube 12, a plate 14, and a pumping module 16. The plate 14 and the pumping module 16 are coupled to a first end 18 and a second end 20 of the tube 12, respectively. The tube 12 defines a reservoir 22 that is configured to position a lotion, such as a moisturizing lotion and a sunscreen lotion. The tube 12 is circularly shaped when viewed longitudinally. The tube 12 comprises plastic and is substantially transparent so that the lotion within the tube 12 is visible. The tube being transparent allow a user to see how much lotion is positioned in the reservoir 22.

A hole 24 that is positioned in the tube 12 opens into the reservoir 22 so that the hole 24 is configured to add the lotion to the reservoir 22. A cap 26 is selectively couplable to the tube 12 to sealably close the hole 24. The hole 24 is threaded so that the cap 26 is threadedly couplable to the tube 12 to sealably close the hole 24.

The plate 14 is disc shaped. A pad 28 is coupled to and substantially covers a first face 30 of the plate 14. The pad 28 is removably couplable to the plate 14. The pad 28 comprises at least one of rubber and silicone.

Figure 3:
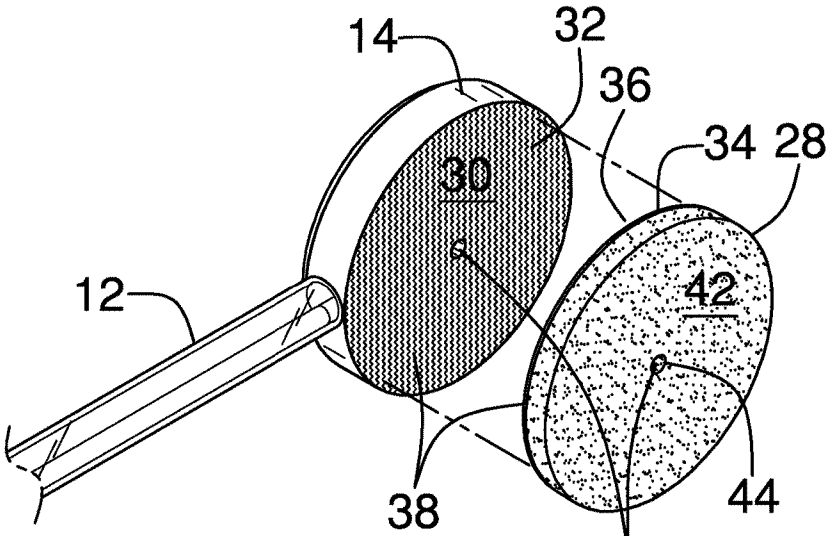
FIG. 3 is a detail isometric perspective view of an embodiment of the disclosure.

A first coupler 32 is coupled to the first face 30 of the plate 14. A second coupler 34 is coupled to a rear face 36 of the pad 28. The second coupler 34 is complementary to the first coupler 32 so that the second coupler 34 is positioned to selectively couple to the first coupler 32 to removably couple the pad 28 to the plate 14. The second coupler 34 and the first coupler 32 comprise a hook and loop fastener 38, as shown in FIG. 3.

Figure 4:
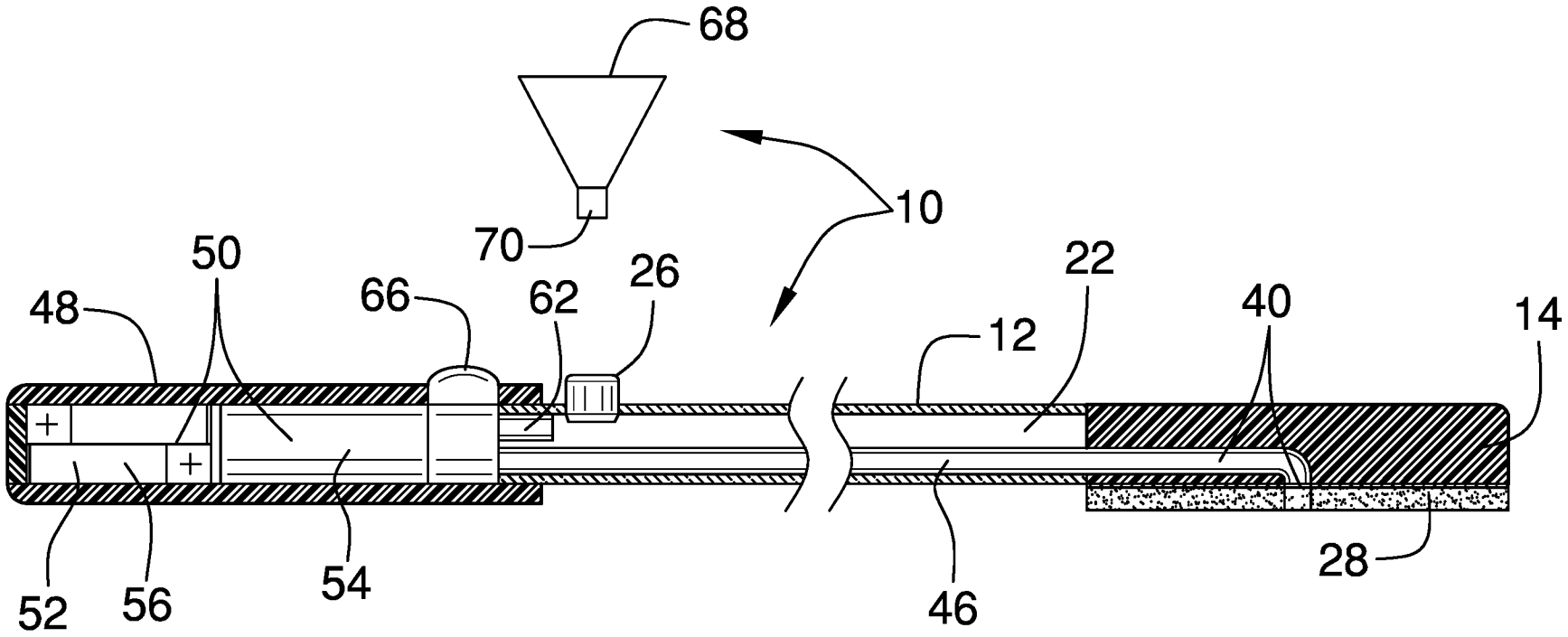
FIG. 4 is a cross-sectional view of an embodiment of the disclosure.

A channel 40 extends from a front face 42 of the pad 28 through the pad 28 and the plate 14 to the tube 12. The channel 40 extends from a center 44 of the front face 42 of the pad 28. An outlet pipe 46 is coupled to the pumping module 16 and extends through the tube 12 to the plate 14 so that the pumping module 16 is fluidically coupled to the channel 40, as shown in FIG. 4. The pumping module 16 is configured to selectively transfer the lotion from the reservoir 22 through the outlet pipe 46 and the channel 40 to the front face 42 of the pad 28 so that the lotion is applicable to a skin surface. The device 10 is particularly useful in applying the lotion to hard to reach areas, such as a back of the user. The device 10 allows the user to independently apply lotion to the hard to reach areas and reduces mess in applying lotion.

The pumping module 16 comprises a housing 48 that defines an interior space 50. The housing 48 is circularly shaped when viewed longitudinally. The housing 48 is colinear with the tube 12 and is configured to be grasped in a hand of the user, positioning the user to manipulate the pad 28 on the skin surface. The housing 48 is circumferentially larger than the tube 12.

A power module 52 and a pump 54 are coupled to the housing 48 and are positioned in the interior space 50. The power module 52 comprises a battery 56, which is rechargeable.

Figure 2:
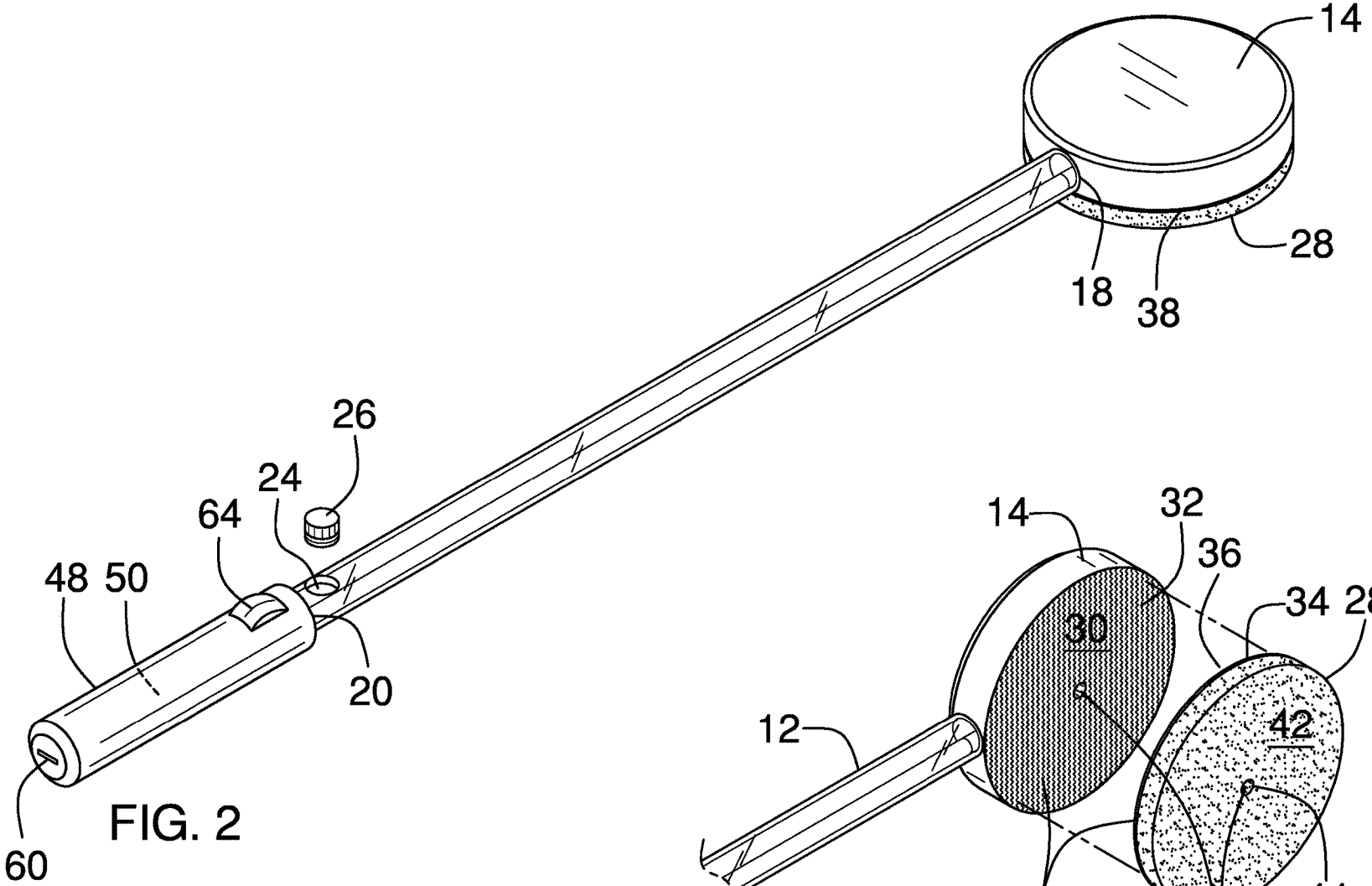
FIG. 2 is a rear isometric perspective view of an embodiment of the disclosure.

A first connector 58 is coupled to the housing 48. The first connector 58 is operationally coupled to the battery 56. The first connector 58 is configured to couple to a second connector of a charging cord (not shown) to couple the battery 56 to a source of direct current to charge the battery 56. The first connector 58 comprises a Universal Serial Bus port 60, as shown in FIG. 2.

The pump 54 is operationally coupled to the power module 52. An inlet pipe 62 is coupled to the pump 54 and extends into the reservoir 22, as shown in FIG. 4. The inlet pipe 62 is configured to draw the lotion from the reservoir 22 to the pump 54.

A switch 64 is coupled to the housing 48. The switch 64 is operationally coupled to the power module 52 and the pump 54. The switch 64 is configured to be switched to selectively operationally couple the pump 54 to the power module 52. The switch 64 comprises a button 66, which is depressible. The button 66 is configured to be depressed a first time to operationally couple the pump 54 to the power module 52 and to be depressed a second time to decouple the pump 54 from the power module 52.

The device 10 also comprises a funnel 68 that has a nozzle 70, which is sized to be selectively inserted into the hole 24. The funnel 68 thus is configured to pour the lotion into the reservoir 22.

Figure 5:
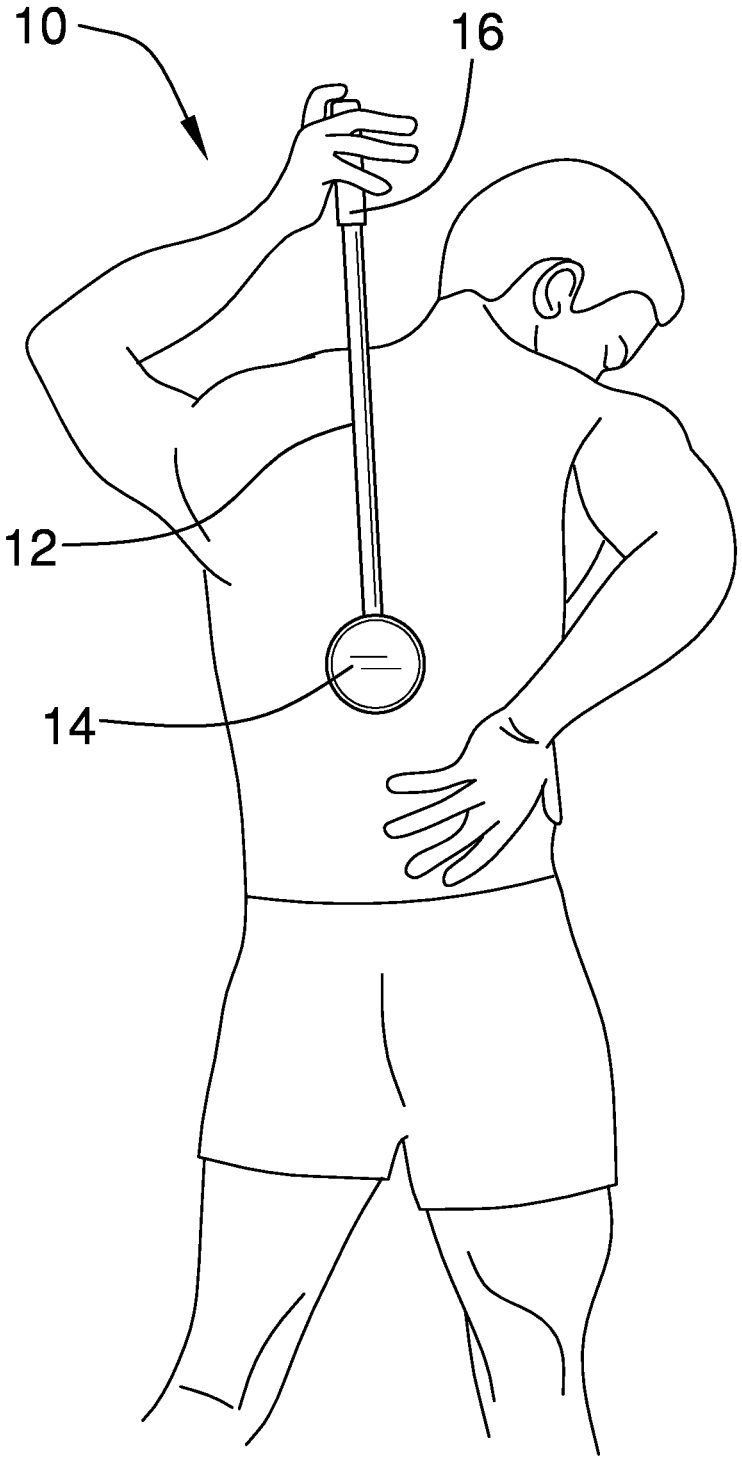
FIG. 5 is an in-use view of an embodiment of the disclosure.

In use, the reservoir 22 is filled with the lotion of choice and the hole 24 is closed with the cap 26. The user then grasps the housing 48 and manipulates the pad 28 to the skin surface, as shown in FIG. 5. The button 66 is depressed to selectively actuate the pump 54 so that the lotion is dispensed onto the front face 42 of the pad 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A lotion dispensing and applying device comprising:

a tube defining a reservoir configured for positioning a lotion;

a plate coupled to a first end of the tube;

a pad coupled to and substantially covering a first face of the plate;

a channel extending from a front face of the pad through the pad and the plate to the tube;

a pumping module coupled to a second end of the tube, the pumping module comprising a housing defining an interior space, the housing being colinear with the tube wherein the housing is configured for grasping in a hand of a user positioning the user for manipulating the pad on a skin surface, a power module coupled to the housing and positioned in the interior space, a pump coupled to the housing and positioned in the interior space, the pump being operationally coupled to the power module, and an inlet pipe coupled to the pump and extending into the reservoir towards the plate wherein the inlet pipe is configured for drawing of the lotion from the reservoir away from the plate and into the pump; and an outlet pipe coupled to the pump of the pumping module and extending through an entirety of the reservoir within the tube to the plate such that the pumping module is fluidically coupled to the channel wherein the pumping module is configured for selectively transferring the lotion from the reservoir through the outlet pipe and the channel to the front face of the pad such that the lotion is applicable to a skin surface.

2. The device of claim 1, further including the tube comprising plastic.

3. The device of claim 2, further including the tube being substantially transparent such that the lotion within the tube is visible.

4. The device of claim 1, further including the pad being removably couplable to the plate.

5. The device of claim 1, further including the pad comprising at least one of rubber and silicone.

6. The device of claim 1, further including the channel extending from a center of the front face of the pad.

7. The device of claim 1, further comprising:

a hole positioned in the tube such that the hole opens into the reservoir wherein the hole is configured for adding the lotion to the reservoir; and a cap selectively couplable to the tube for sealably closing the hole.

8. The device of claim 7, further including the hole being threaded such that the cap is threadedly couplable to the tube for sealably closing the hole.

9. The device of claim 1, further including the tube and the housing being circularly shaped when viewed longitudinally, the housing being circumferentially larger than the tube.

10. The device of claim 1, further comprising:

the power module comprising a battery, the battery being rechargeable; and a first connector coupled to the housing, the first connector being operationally coupled to the battery wherein the first connector is configured for coupling to a second connector of a charging cord for coupling the battery to a source of direct current for charging the battery.

11. The device of claim 10, further including the first connector comprising a Universal Serial Bus port.

12. The device of claim 1, further including a switch coupled to the housing, the switch being operationally coupled to the power module and the pump wherein the switch is configured for switching for selectively operationally coupling the pump to the power module.

13. The device of claim 12, further including the switch comprising a button, the button being depressible wherein the button is configured for depressing a first time for operationally coupling the pump to the power module and for depressing a second time for decoupling the pump from the power module.

14. The device of claim 7, further including a funnel having a nozzle sized for selectively inserting into the hole wherein the funnel is configured for pouring the lotion into the reservoir.

15. The device of claim 1, further including the plate being disc shaped.

16. The device of claim 4, further comprising:

a first coupler coupled to the first face of the plate; and a second coupler coupled to a rear face of the pad, the second coupler being complementary to the first coupler such that the second coupler is positioned for selectively coupling to the first coupler for removably coupling the pad to the plate.

17. The device of claim 16, further including the second coupler and the first coupler comprising a hook and loop fastener.

18. A lotion dispensing and applying device comprising:

a tube defining a reservoir configured for positioning a lotion, the tube being circularly shaped when viewed longitudinally, the tube comprising plastic, the tube being substantially transparent such that the lotion within the tube is visible;

a plate coupled to a first end of the tube, the plate being disc shaped;

a pad coupled to and substantially covering a first face of the plate, the pad being removably couplable to the plate, the pad comprising at least one of rubber and silicone;

a first coupler coupled to the first face of the plate;

a second coupler coupled to a rear face of the pad, the second coupler being complementary to the first coupler such that the second coupler is positioned for selectively coupling to the first coupler for removably coupling the pad to the plate, the second coupler and the first coupler comprising a hook and loop fastener;

a channel extending from a front face of the pad through the pad and the plate to the tube, the channel extending from a center of the front face of the pad;

a hole positioned in the tube such that the hole opens into the reservoir wherein the hole is configured for adding the lotion to the reservoir, the hole being threaded;

a cap selectively couplable to the tube for sealably closing the hole, the cap being threadedly couplable to the tube for sealably closing the hole;

a pumping module coupled to a second end of the tube, the pumping module comprising:

a housing defining an interior space, the housing being circularly shaped when viewed longitudinally, the housing being colinear with the tube wherein the housing is configured for grasping in a hand of a user positioning the user for manipulating the pad on a skin surface, the housing being circumferentially larger than the tube, a power module coupled to the housing and positioned in the interior space, the power module comprising a battery, the battery being rechargeable, a pump coupled to the housing and positioned in the interior space, the pump being operationally coupled to the power module, a first connector coupled to the housing, the first connector being operationally coupled to the battery wherein the first connector is configured for coupling to a second connector of a charging cord for coupling the battery to a source of direct current for charging the battery, the first connector comprising a Universal Serial Bus port, an inlet pipe coupled to the pump and extending into the reservoir towards the plate wherein the inlet pipe is configured for drawing of the lotion from the reservoir away from the plate and into the pump, and a switch coupled to the housing, the switch being operationally coupled to the power module and the pump wherein the switch is configured for switching for selectively operationally coupling the pump to the power module, the switch comprising a button, the button being depressible wherein the button is configured for depressing a first time for operationally coupling the pump to the power module and for depressing a second time for decoupling the pump from the power module;

an outlet pipe coupled to the pump of the pumping module and extending through an entirety of the reservoir within the tube to the plate such that the pumping module is fluidically coupled to the channel wherein the pumping module is configured for selectively transferring the lotion from the reservoir through the outlet pipe and the channel to the front face of the pad such that the lotion is applicable to the skin surface; and a funnel having a nozzle sized for selectively inserting into the hole wherein the funnel is configured for pouring the lotion into the reservoir.

* * * * *